US007089847B2

(12) United States Patent
Bakke

(10) Patent No.: US 7,089,847 B2
(45) Date of Patent: Aug. 15, 2006

(54) HYDRAULIC CAM MOTOR

(75) Inventor: Stig Bakke, Ålgård (NO)

(73) Assignee: Weatherford/Lamb, Inc., Houston, TX (US)

( * ) Notice: Subject to any disclaimer, the term of this patent is extended or adjusted under 35 U.S.C. 154(b) by 400 days.

(21) Appl. No.: 10/432,128

(22) PCT Filed: Nov. 14, 2001

(86) PCT No.: PCT/NO01/00452

§ 371 (c)(1),
(2), (4) Date: May 20, 2003

(87) PCT Pub. No.: WO02/42596

PCT Pub. Date: May 30, 2002

(65) Prior Publication Data

US 2004/0028536 A1 Feb. 12, 2004

(30) Foreign Application Priority Data

Nov. 24, 2000 (NO) ..... 20005973

(51) Int. Cl.
*F01B 13/06* (2006.01)

(52) U.S. Cl. ..... 91/492; 91/498

(58) Field of Classification Search ..... 91/491, 91/492, 498

See application file for complete search history.

(56) References Cited

U.S. PATENT DOCUMENTS

| | | | | |
|---|---|---|---|---|
| 4,202,252 | A * | 5/1980 | Scheufler et al. | 91/483 |
| 4,225,000 | A | 9/1980 | Maurer | 175/107 |
| 4,828,053 | A | 5/1989 | Maurer et al. | 175/75 |
| 5,558,003 | A * | 9/1996 | Bauzou et al. | 91/492 |

FOREIGN PATENT DOCUMENTS

| | | |
|---|---|---|
| FR | 2697055 | 4/1994 |
| WO | WO 99/24711 | 5/1999 |

OTHER PUBLICATIONS

International Search Report dated Feb. 25, 2002, for application No. PCT/NO01/00452.

* cited by examiner

*Primary Examiner*—Charles G. Freay
(74) *Attorney, Agent, or Firm*—Patterson & Sheridan

(57) ABSTRACT

A compressed fluid driven downhole cam motor (1) of the type used during drilling/service operations in the ground, comprising an intermediate casing (4), a distributing valve (26), a rotor (18) and two or more pistons (48) arranged radially and distributed with equal or unequal separation about the central axis of the rotor (18), whereby the pistons (48) located in the same radial plane constitute a set of pistons, and where two or more sets of pistons are arranged side by side along the longitudinal axis of the rotor (18).

21 Claims, 7 Drawing Sheets

V–V

V–V

V–V

V-V

II-II

HYDRAULIC CAM MOTOR

This invention regards a compressed fluid driven downhole cam motor for use in drilling/well operations in the ground.

During directional drilling in a formation in the ground, e.g. during horizontal drilling of a well, it is common to use drilling equipment comprising a drill string, a drill string link and a drill bit. The drill string may be constituted by coiled tubing, and the drill bit may be driven hydraulically by the fluid circulating in the drill string. The direction of drilling is changed by rotating the drill string link, and the rotation is performed by a tool disposed between the lower end of the drill string and the drill string link. In most known tools, the rotation is not infinitely variable, but must be carried out at fixed angular deflections of the order of 15–20 degrees. This means that the direction of drilling can not be changed with the desired accuracy. Another disadvantage of most known tools of this type is that the effort of the drill bit must be reduced in order to allow rotation of the drill string link. A consequence of this may be that the drill bit looses its hold on the ground formation, causing the drill string link to return to the initial position instead of completing the rotation. These are conditions that complicate and also delay the work of changing the direction of drilling.

In other well operations, there may be a need for both volume- and pressure-controlled compressed fluid motors. Motors of this type, which rotate continuously, has a high torque and also require little space, are not known.

Moreover, most cam motors according to prior art take up a relatively large amount of space in the longitudinal direction of the drilling device, are slow, and are not designed to rotate continuously.

The invention aims to remedy the disadvantages of prior art.

The aim is achieved in accordance with the invention by the characteristics given in the description below and in the following claims.

Radial piston motors are well suited to providing a relatively high torque at modest overall dimensions. Nevertheless, it is difficult to achieve sufficiently high torque with the structural dimensions that can be used in underground drilling tools. A radial piston motor according to the invention is provided with two or more co-ordinated sets of radial pistons. One set of pistons is here taken to mean one set of pistons as they are arranged in a radial piston motor or radial piston engine of a type that is known per se. The pistons from the individual sets of pistons may be arranged so as to form axial banks, or arranged in another geometrical pattern.

In a preferred embodiment, the pistons associated with each of the co-ordinated sets of pistons may be arranged along imaginary axial lines with mutually equal separation about the central axis of the radial piston motor. However, in order to be able to use a sufficient number of pistons having sufficient dimensions, every other set of radial pistons is rotated about said central axis, so that the pistons, when seen along the central axis, are positioned between the pistons of the adjacent set of pistons. This rotationally staggered arrangement of the pistons allows more pistons to be assigned to a given volume without the cylinder bore of each individual piston coinciding with the cylinder bore of the adjoining cylinder. A distributing valve distributes compressed fluid to the pistons in accordance with techniques that are known per se. The piston cylinders that form a bank along each of said imaginary axial lines are connected to a common compressed fluid duct, which allows them to communicate and causes them to be displaced simultaneously under the influence of compressed fluid while the cam motor rotates. Each bank of pistons abuts a common bearing cylinder, which in turn abuts the undulated interior of the cam motor casing. The detailed functioning of the cam motor will be explained in the specific part of the description, with reference to the appended drawings.

Due to its small overall dimensions and potentially high torque, a hydraulic cam motor according to the invention is particularly well suited for use in downhole drilling devices.

In its basic configuration, the hydraulic cam motor is a volume-controlled actuator, as its angle of rotation depends directly on the volume of compressed fluid flowing through the cam motor. In this mode of operation, the cam motor is well suited for tasks where the angle of rotation must be controlled with great accuracy, and also for continuous rotation.

By providing the cam motor with a flow-regulating valve, e.g. in the form of a bore/nozzle through which part of the compressed fluid may pass without passing through the cam motor, a certain pressure control effect may be achieved. This may be explained by the fact that when the cam motor is not rotating, e.g. because it is not able to overcome the moment of resistance to rotation in question, the pressure drop across the nozzle will determine the magnitude of the differential pressure to which the cam motor is subjected. The pressure drop across the nozzle is determined by the volumetric flow through the nozzle. Thus upstream or downstream flow regulating means may be used to regulate the torque of the cam motor. A volume- or pressure-controlled valve may for instance be controlled so as to close/open the flow regulating bore/nozzle/valve temporarily.

Start-up and shutdown of the cam motor may also be performed by using e.g. arrangements of brakes and locks according to prior art, where a volume-controlled stop valve or throttle valve unloads/loads the brake/lock arrangement and/or closes/opens for compressed fluid to the cam motor.

In an embodiment for continuous rotation, e.g. of the drill string link for the purpose of improving the flow conditions around the drill string, the cam motor is equipped with a through flow orifice designed to lead the volume flow through the cam motor without any significant pressure drop. Compressed fluid flowing through the cylinders of the cam motor is drained to the outside of the cam motor. Thus the torque of the cam motor is directly proportional to the pressure drop of the compressed fluid downstream of the cam motor.

The cam motor may also be used as a hydraulic pump, in principle without modifications. The cam motor may also be designed so as to leave the pistons arranged in the intermediate casing, working against a profiled rotor.

The following describes a non-limiting example of a preferred embodiment illustrated in the accompanying drawings, in which.

Figure 1:
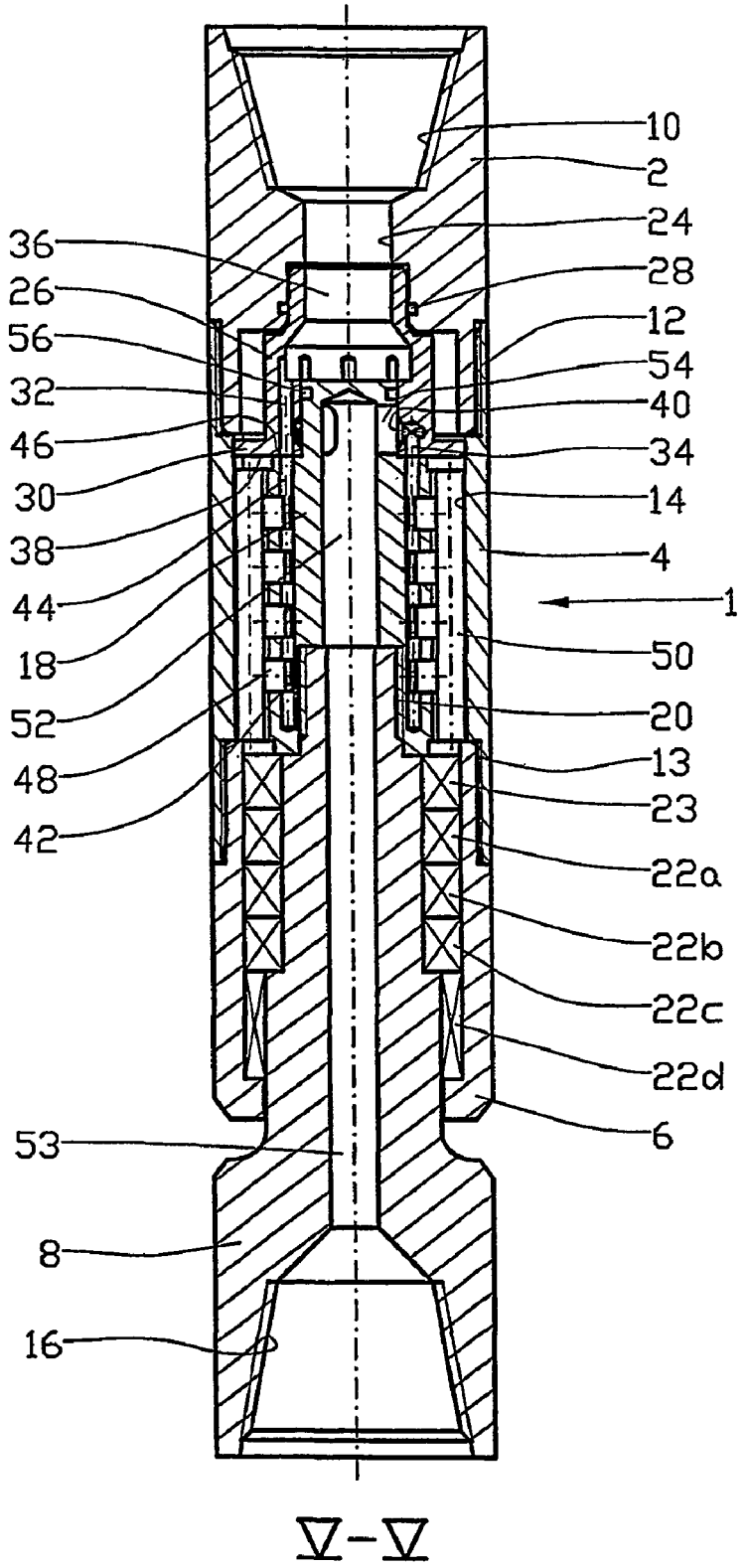
FIG. 1 is a longitudinal sectional view of the cam motor.
Figure 2:
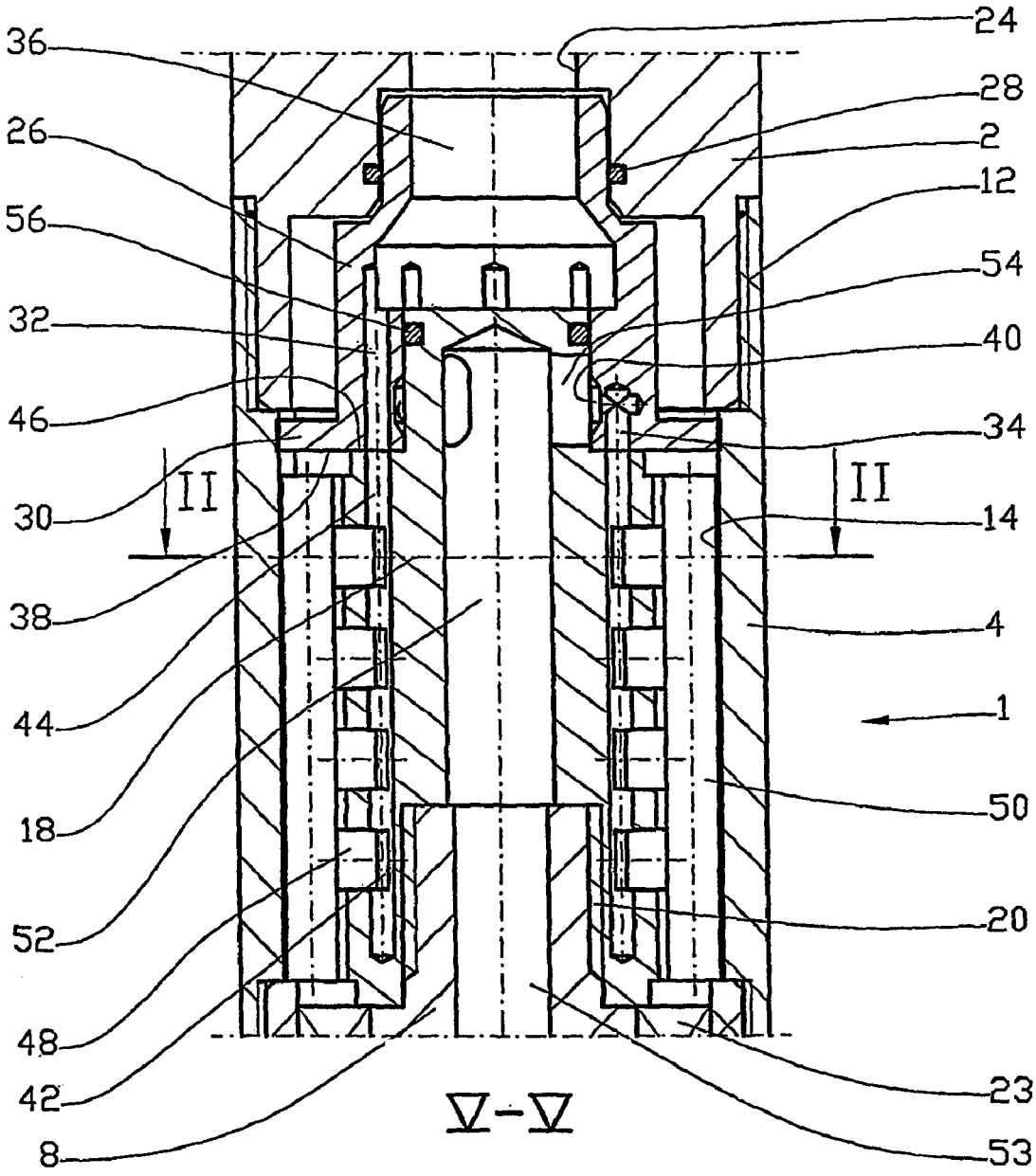
FIG. 2 shows a cutout from FIG. 1 on a larger scale.

In the drawings, reference number 1 denotes a hydraulic cam motor comprising an inlet coupling 2, an intermediate casing 4, a bearing housing 6 and an outlet coupling 8. One end of the inlet coupling 2 is provided with a threaded portion 10 that matches a connecting portion of an upstream drill string (not shown) in a complementary manner, and at the other end the inlet coupling 2 is rigidly connected to the intermediate casing 4 via thread 12. The intermediate casing 4 is rigidly connected to the bearing housing 6 via thread 13, while the interior of the intermediate casing 4 is provided with a profiled surface 14. The inlet coupling 2, the intermediate casing 4 and the bearing housing 6 form the external, rotationally static enclosure of the cam motor 1.

The projecting end portion of the outlet coupling 8 is provided with a threaded portion 16 that matches a connecting portion of a downstream drill string (not shown) in a complementary manner. The inside end portion of the outlet coupling 8 is connected to a rotor 18 via thread 20, and is rotatably mounted in the bearing housing 6 via thrust bearings and radial bearings 22*a*, 22*b*, 22*c* and 22*d*. An internal nut 23 prevents the bearings 22*a* to 22*d* from being displaced in the housing 6. The outlet coupling 8 forms the output shaft of the cam motor 1.

The inlet coupling 2 is provided with a through opening 24. A distributing valve 26 is placed in the inlet coupling 2, where a gasket 28 stops fluid flow between the inlet coupling 2 and the distributing valve 26. The flange-like end portion 30 of the distributing valve 26 is disposed in the intermediate casing 4 and fits in the profiled surface 14 in the intermediate casing 4 in a complementary manner, and is thereby rigidly connected to the intermediate casing 4 rotational-wise. The distributing valve 26 is provided with a certain number of inlet bores 32 and a corresponding number of outlet bores 34. The inlet bores 32 connect the central chamber of the distributing valve 26 with the valve facing 38. The outlet bores 34 connect the valve facing 38 with the outlet port 40.

The rotor 18 is provided with a number of radial cylinder bores 42. In the preferred embodiment shown, the cylinders 42 are arranged in 12 axial banks. The number of cylinders 42 in each bank is adjusted according to the desired torque of the cam motor 1. The cylinders 42 of each bank communicate with each other through a bore 44 that ends up in an end face 46 of the rotor 18. A radial piston 48 is arranged in each cylinder 42. All pistons 48 located in a common bank of cylinders are connected to a roller 50. The roller 50 is rotatably supported in the pistons 48, and abuts the profiled surface in the intermediate casing 4. The rotor 18 is provided with a bore 52 that forms an extension of the central through bore 53 of the outlet coupling 8, communicating with the outlet port 40 via ports 54. A gasket 56 seals against fluid leaks from the central chamber 36 to the outlet port 40. The contact pressure between the valve facing 38 of the distributing valve 26 and the end face 46 of the rotor 18 is hydraulically balanced, in that the fluid pressure acts on that part of the net upstream cross-sectional area of the distributing valve 26 which is situated between the gaskets 28 and 56.

Figure 6:
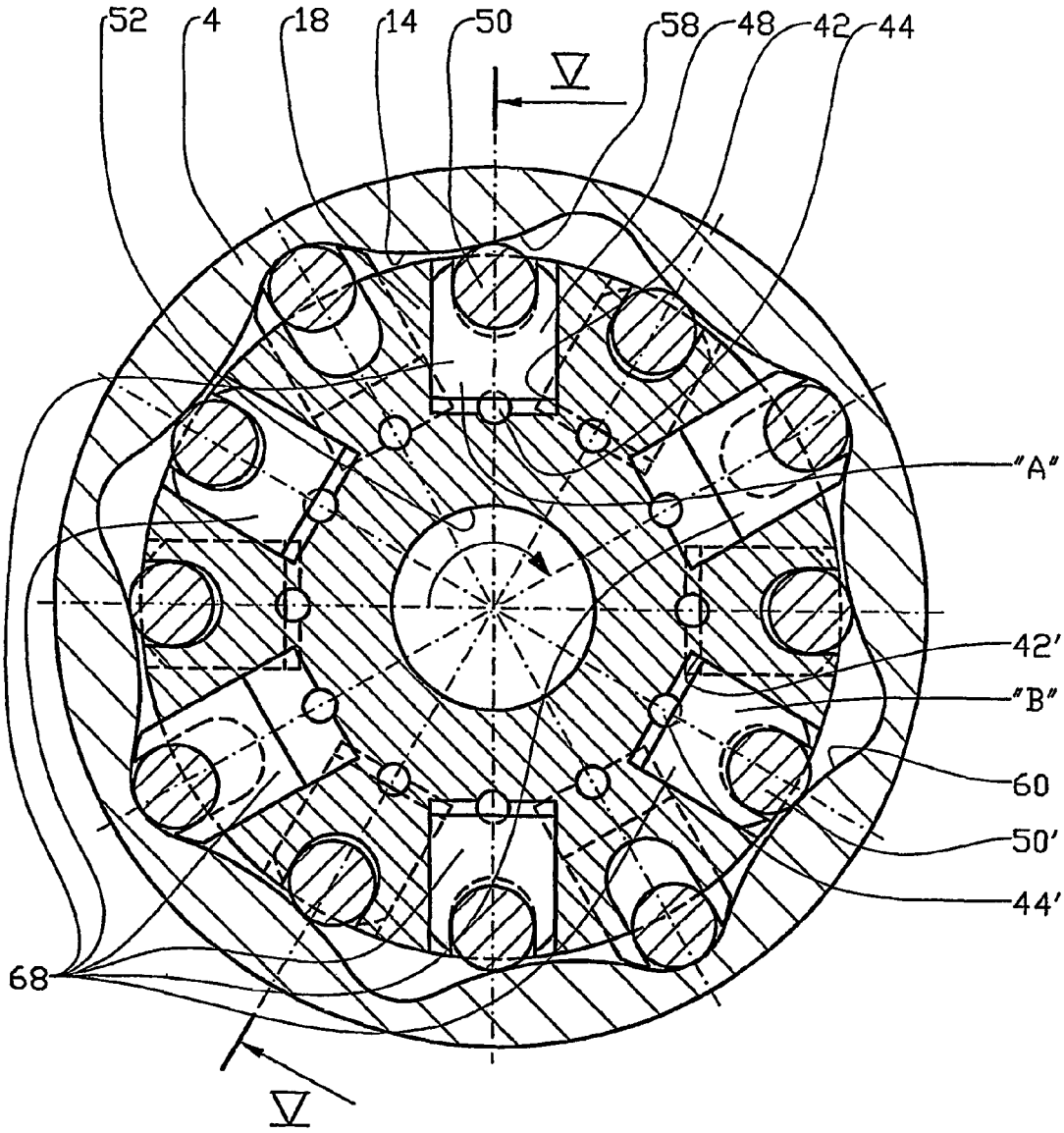
FIG. 6 is a sectional view of the cam motor of FIG. 2.
Figure 7:
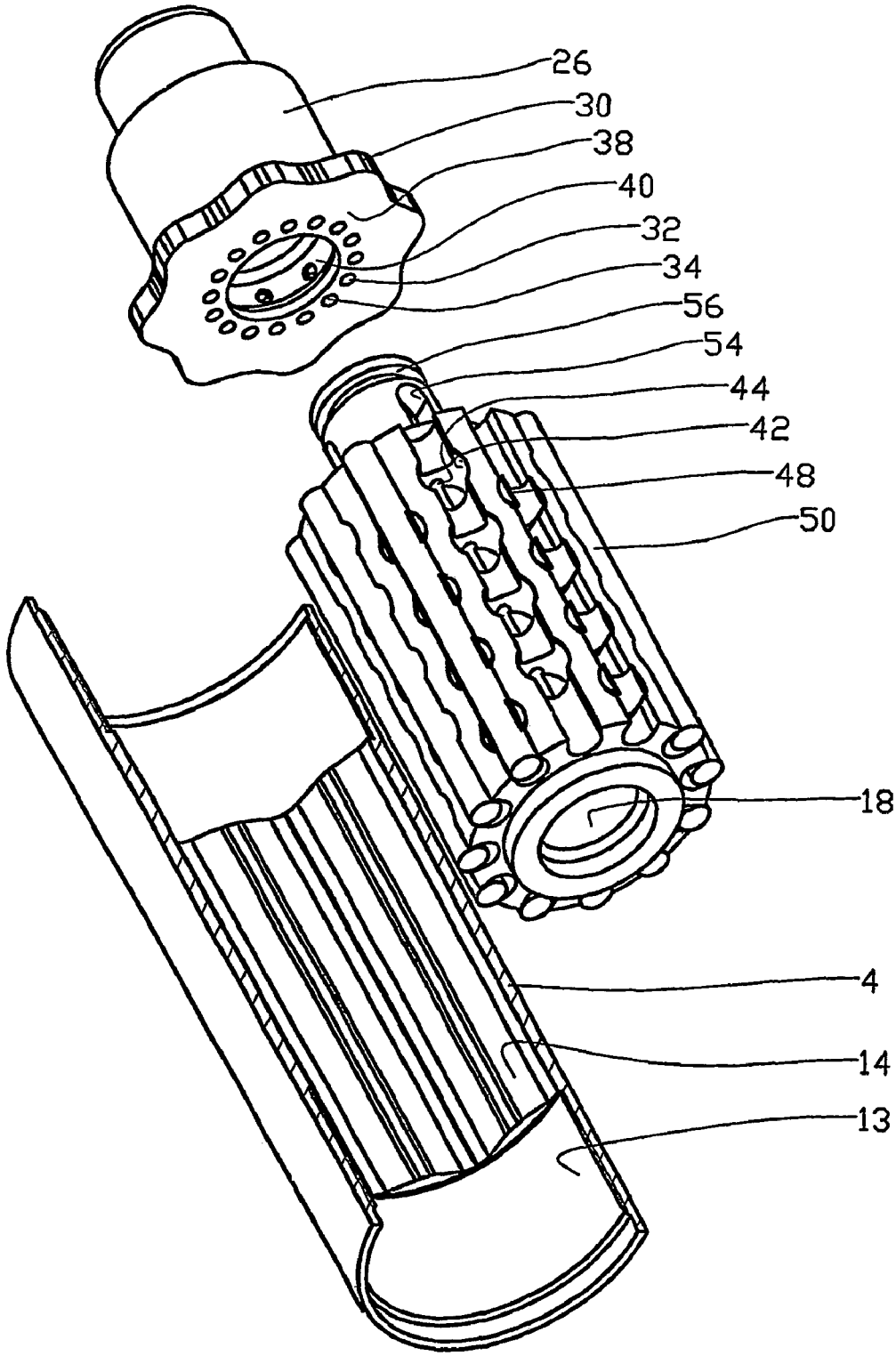
FIG. 7 is a perspective, partly exploded view in which several of the main components of the cam motor are illustrated.

The section in FIG. 6 shows six sets of radial pistons 48 with associated cylinders 42, which sets form a set 68 of pistons such as is known per se from conventional radial piston motors. The co-ordinated set of pistons along the longitudinal axis of the rotor 18 can be shifted rotationally, so that the pistons in this set are situated between the pistons in the adjacent sets of pistons, seen along the longitudinal axis of the rotor 18. By arranging the sets of pistons in such a rotationally staggered manner, more cylinders 42 may be placed in a rotor 18 without the cylinders getting too close to each other.

When the cylinder 42, see cylinder "A" in FIG. 6, is supplied with compressed fluid through the bore 44, the piston 48 is displaced out towards the roller 50 abutting one bevel 58 of the cam-shaped profiled surface 14 in the intermediate casing 4. The rotor 18 is thereby caused to rotate in the direction of the arrow. Correspondingly, fluid must flow out of the cylinder 42' when the roller 50' is displaced along the opposite bevel 60 of the cam-shaped profile, see cylinder "B" in FIG. 6.

On operation of the cam motor 1, compressed fluid flows through the bore 24 of the inlet coupling 2 and into the central chamber 36 of the distributing valve 26, and further into the inlet bores 32 of the distributing valve 26. One or more of the inlet bores 32 correspond completely or partially with the bores 44 of the rotor 18, through which the cylinder 42 located by a bevel 58 on the intermediate casing 4 is supplied with compressed fluid. One or more of the outlet bores 34 correspond completely or partially with bores 44', through which cylinders 42' located by a bevel 60 drain compressed fluid. Thus compressed fluid flows into cylinders 42, where the associated piston 48 with roller 50 is displaced out towards the bevel 58. By so doing, the rotor 18 is caused to rotate. When the piston 48 and the roller 50 reaches the fully extended position, the inlet bore 32 no longer corresponds with the bore 44 in question, and the supply of compressed fluid stops. When the rotor is rotated further, the bore 44 corresponds with one of the outlet bores 34. Fluid flows out of the cylinder 42 through the bore 44, the outlet bore 34, the outlet port 40, the openings 54 and further through the bores 52 and 53. By several banks of cylinders being in different positions relative to the cam-shaped profile 14 in the intermediate casing 4, the cam motor 1 rotates continuously upon supply of compressed fluid, see FIG. 6.

Figure 3:
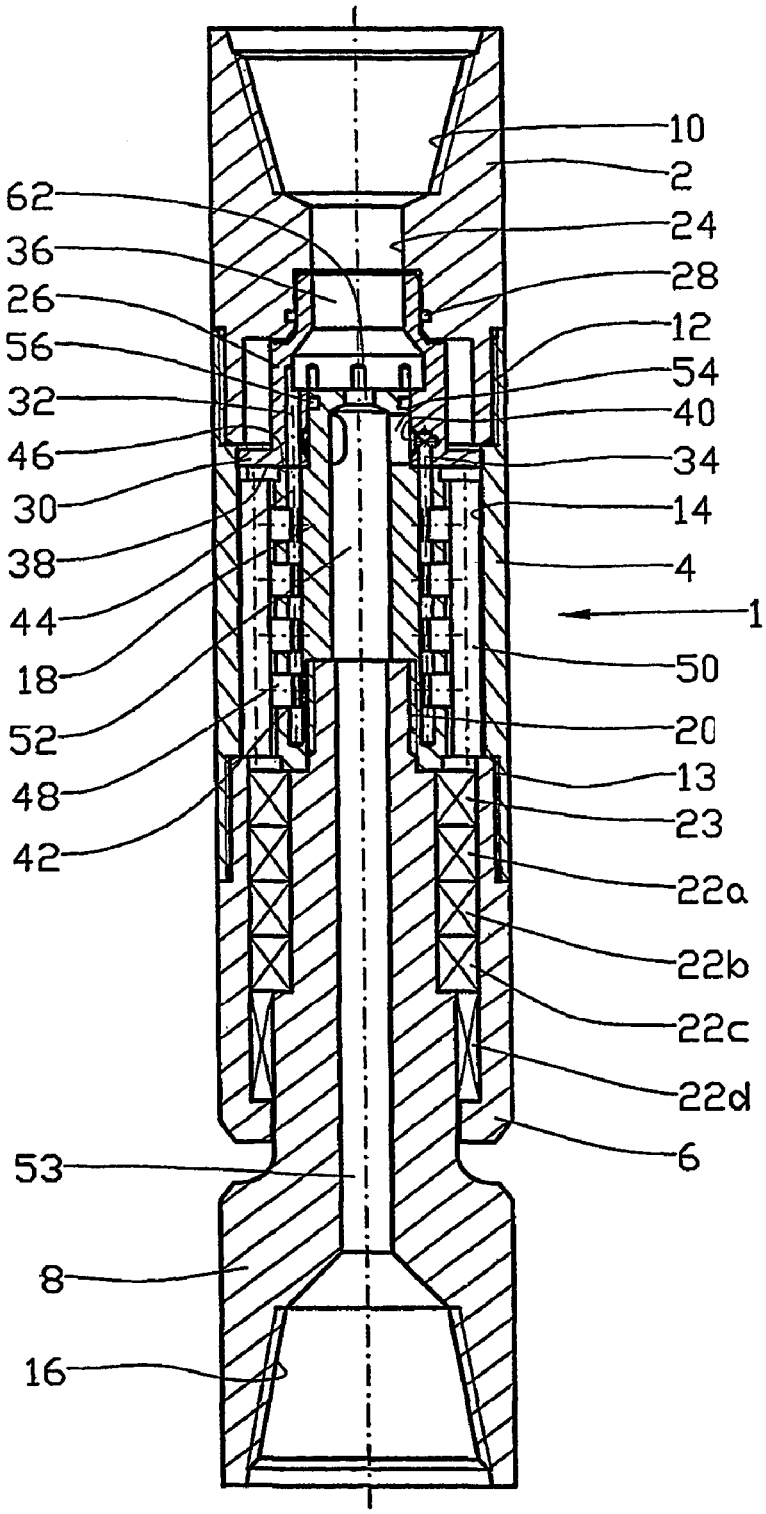
FIG. 3 is a sectional view of an alternative embodiment.

In an alternative embodiment, see FIG. 3, the rotor 18 is provided with a through bore 62 that forms a throttle between the central chamber 36 of the distributing valve 26 and the bore 52 of the rotor 18. The flow rate in the bore 62 depends on the pressure drop through the bore 62, and this design is used to achieve a certain amount of pressure control of the cam motor 1, such as described in the general part of the description.

Figure 4:
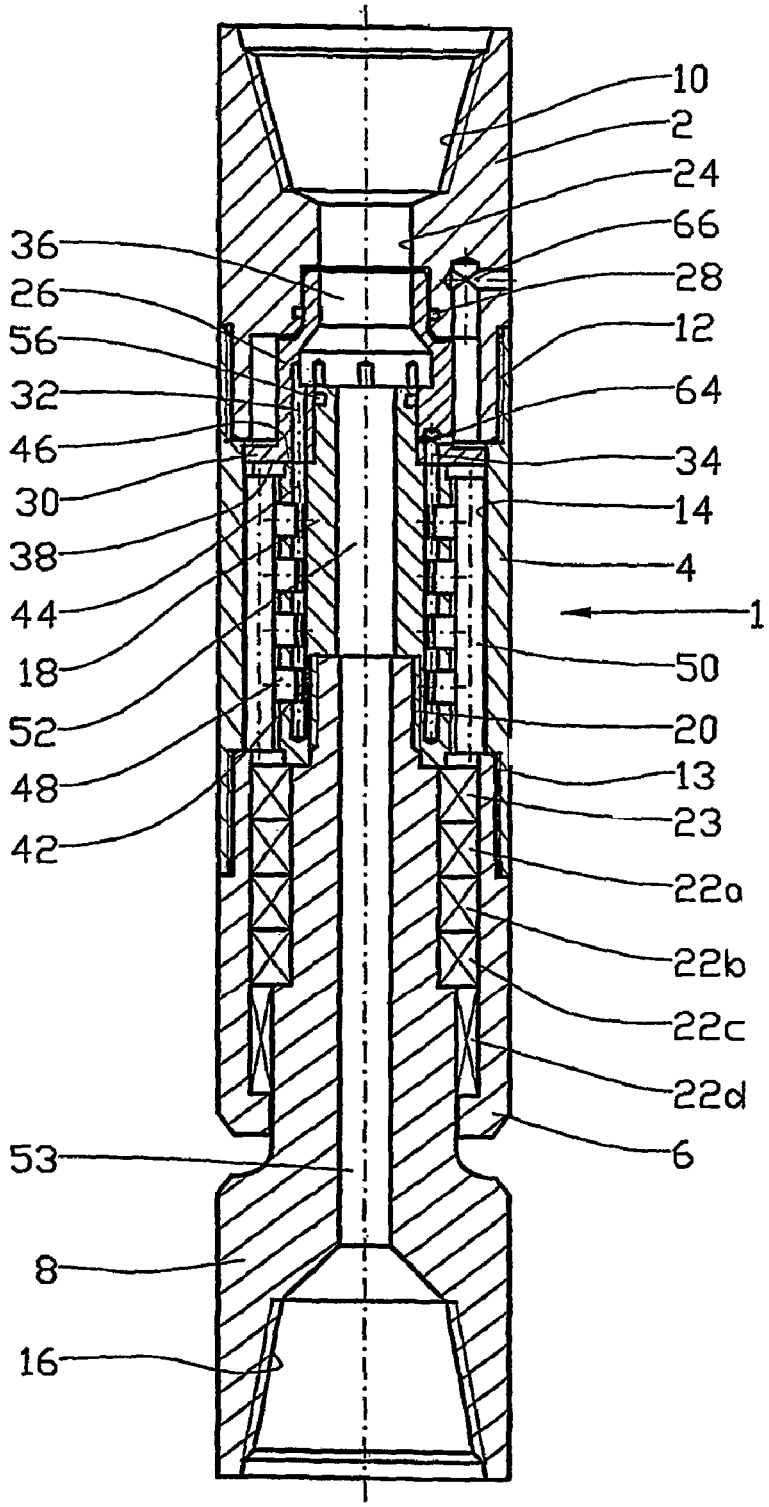
FIG. 4 is a sectional view of a further embodiment.

In a further embodiment, see FIG. 4, the bore 52 of the rotor 18 is through-going, and the outlet port 40 has been removed. In this embodiment, the outlet bores 34 communicate with the outside of the enclosure of the cam motor 1 through bores 64 and 66. In this embodiment, the torque of the cam motor 1 is directly dependent on a downstream back pressure.

Figure 5:
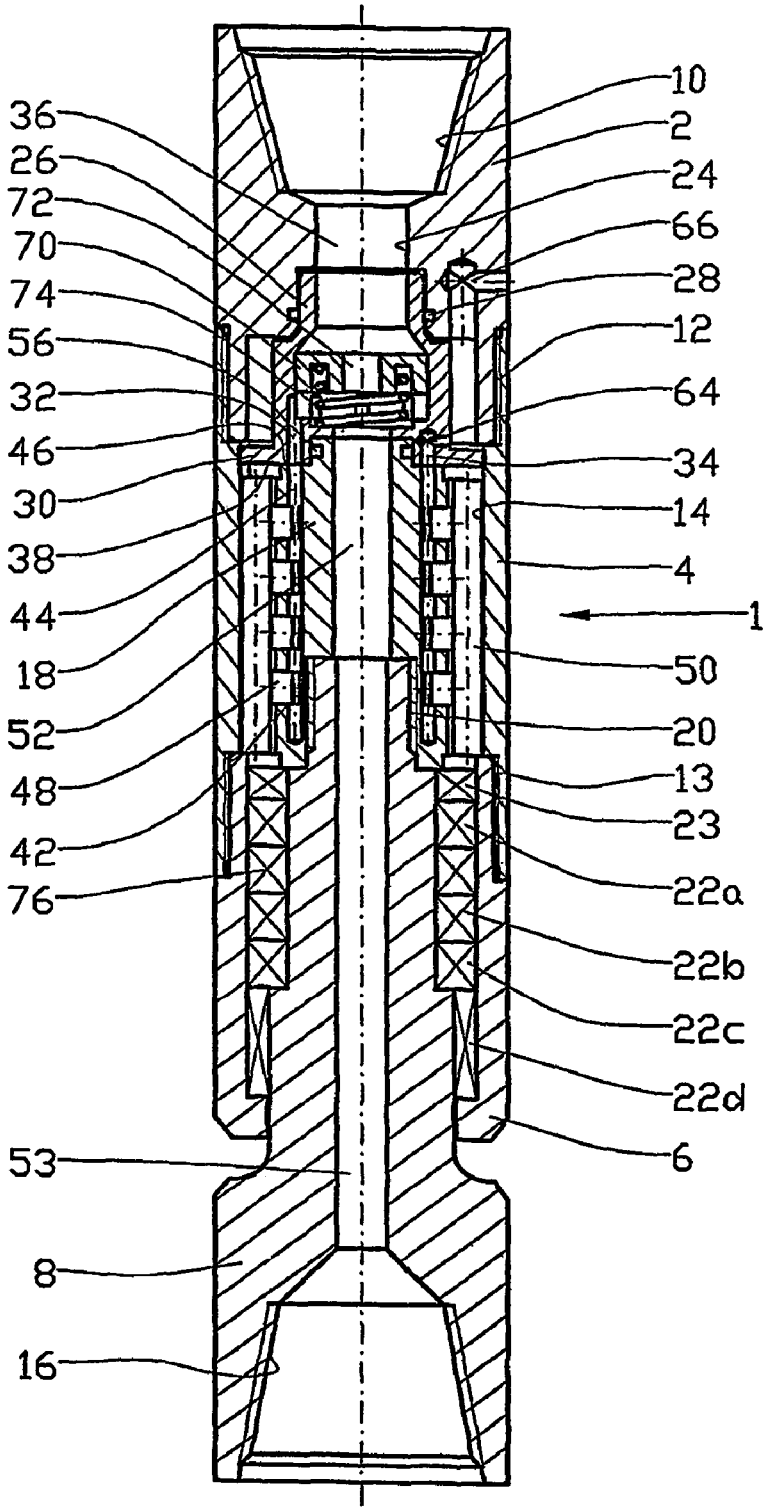
FIG. 5 is a sectional view of a further embodiment.

In a further embodiment, see FIG. 5, the cam motor 1 is provided with a volume-controlled throttle/stop valve 70. The compressed fluid flows through the valve-70-bore 72, at a certain flowrate overcoming the force from a spring 74, whereby the valve 70 is displaced to stop compressed fluid flowing into the inlet bores 32. The cam motor 1 may if so required be equipped with a free wheel 76 of a type that is known per se, which prevents the rotor 18 from rotating in the opposite rotating direction relative to the working direction when the supply of compressed fluid is shut off. By reducing the flow of compressed fluid, the force from the spring 74 overcomes the force of the compressed fluid, so that the valve 70 is displaced to its inactive position, whereupon the cam motor 1 starts up again. When compared to known cam motors for downhole applications, the cam motor 1 distinguishes itself by achieving a relatively high torque while having modest overall dimensions, and by being designed to be rotated continuously whilst being simple to control in respect of angle of rotation, moment and speed.

The invention claimed is:

1. A compressed fluid driven downhole cam motor, comprising:

an intermediate casing in which a rotor and a distributing valve are arranged along an essentially common central axis, and two or more pistons arranged radially about the central axis of the rotor, whereby those pistons that are located in the same radial plane constitute a set of pistons, characterized in that two or more sets of pistons are arranged side by side along a longitudinal axis of the rotor;

such that at least one piston from each of two or more sets of pistons share a common flow path for fluid communication with the distributing valve.

2. A device in accordance with claim 1, wherein two adjacent sets of pistons are placed in a rotationally staggered manner about the central axis of the rotor, so that the pistons of one set of pistons are located between the pistons of the adjacent set(s) of pistons.

3. A device in accordance with claim 1, wherein a roller is rotatably supported in two or more of the pistons.

4. A device in accordance with claim 3, wherein a contact pressure between a valve facing of the distributing valve and an end face of the rotor is hydraulically balanced.

5. A device in accordance with claim 1, wherein the cam motor is provided with a throttle in the rotor.

6. A device in accordance with claim 1, wherein the cam motor is provided with a through bore in the rotor.

7. A device in accordance with claim 1, wherein the cam motor is provided with a pressure volume-controlled stop valve designed to shut off a supply of compressed oil to an inlet born.

8. The motor of claim 1, wherein the common flow path is parallel with the central axis of the motor.

9. The device of claim 1, wherein the common flow path is substantially parallel to the common central axis.

10. A drilling system for forming a wellbore, comprising:

a drill string;

a downhole motor having:

a rotor and a distributing valve arranged along an essentially common center line; and two or more sets of pistons arranged side by side along an axis of the rotor, wherein each of the two or more sets of pistons comprises two or more pistons arranged radially about the axis of the rotor and located in the same radial plane; and wherein at least one piston from each of two or more sets of pistons share a common flow path for fluid communication with the distributing valve; and a drilling member rotatable by the downhole motor.

11. The drilling system of claim 10, wherein two adjacent sets of pistons are placed in a rotationally staggered manner.

12. The drilling system of claim 10, wherein a roller is rotatably supported in two or more of the pistons.

13. The drilling system of claim 10, further comprising a drill string link for changing a direction of drilling.

14. The drilling system of claim 10, wherein the at least one pistons from each of two or more sets of pistons sharing the common flow path are displaced simultaneously.

15. The drilling system of claim 10, wherein the common flow path is alternately placed in fluid communication with an inlet bore and an outlet bore.

16. A method of forming a wellbore, comprising:

providing a downhole motor having:

a rotor;

a distributing valve coupled to the rotor; and two or more sets of pistons arranged side by side along an axis of the rotor, wherein each of the two or more sets of pistons comprises two or more pistons arranged radially about the axis of the rotor and located in the same radial plane; and wherein at least one piston from each of two or more sets of pistons share a common flow path for fluid communication with the distributing valve;

lowering the downhole motor into the wellbore; and actuating the downhole motor to rotate a drilling member coupled to the downhole motor, thereby forming a wellbore.

17. The method of claim 16, further comprising simultaneously displacing the at least one pistons sharing the common flow path.

18. The method of claim 16, further comprising altering a trajectory of the wellbore.

19. The method of claim 16, further comprising hydraulically balancing a contact pressure between a valve facing of the distributing valve and an end face of the rotor.

20. The method of claim 16, further comprising positioning the pistons of adjacent sets of pistons in a staggered manner.

21. A compressed fluid driven downhole cam motor, comprising:

an intermediate casing in which a rotor and a distributing valve are arranged along an essentially common center line;

two or more sets of pistons are arranged side by side along a longitudinal axis of the rotor, wherein each set of pistons includes two or more pistons arranged radially about the longitudinal axis of the rotor and in the same radial plane; and a pressure volume-controlled stop valve designed to shut off a supply of compressed oil to an inlet bore of the distributing valve.

* * * * *